US011162276B2

(12) United States Patent
Inan et al.

(10) Patent No.: US 11,162,276 B2
(45) Date of Patent: Nov. 2, 2021

(54) SAFETY DEVICE FOR A MOTOR VEHICLE HAVING A ROTARY LATCH AND AN EJECTION SPRING

(71) Applicant: Kiekert AG, Heiligenhaus (DE)

(72) Inventors: Ömer Inan, Dorsten (DE); Michael Scholz, Essen (DE); Holger Schiffer, Meerbusch (DE); Thomas Schönenberg, Burscheid (DE)

(73) Assignee: Kiekert AG, Heiligenhaus (DE)

( * ) Notice: Subject to any disclaimer, the term of this patent is extended or adjusted under 35 U.S.C. 154(b) by 796 days.

(21) Appl. No.: 16/065,146

(22) PCT Filed: Nov. 28, 2016

(86) PCT No.: PCT/DE2016/100554
§ 371 (c)(1),
(2) Date: Jul. 10, 2018

(87) PCT Pub. No.: WO2017/108022
PCT Pub. Date: Jun. 29, 2017

(65) Prior Publication Data

US 2019/0017291 A1 Jan. 17, 2019

(30) Foreign Application Priority Data

Dec. 22, 2015 (DE) ..... 10 2015 122 583.2

(51) Int. Cl.
*E05B 17/00* (2006.01)
*E05B 83/24* (2014.01)
(Continued)

(52) U.S. Cl.
CPC ..... *E05B 17/0037* (2013.01); *E05B 15/006* (2013.01); *E05B 15/04* (2013.01); *E05B 83/24* (2013.01); *E05B 2015/0486* (2013.01)

(58) Field of Classification Search
CPC .... E05B 17/0037; E05B 15/006; E05B 15/04; E05B 83/24; E05B 2015/0486
See application file for complete search history.

(56) References Cited

FOREIGN PATENT DOCUMENTS

DE 102007007622 A1 * 9/2007 ..... E05B 83/24
DE 102010037937 4/2012
(Continued)

OTHER PUBLICATIONS

International Search Report and Written Opinion for corresponding Patent Application No. PCT/DE2016/100554 dated Feb. 27, 2017.

*Primary Examiner* — Kristina R Fulton
*Assistant Examiner* — Yahya Sidky
(74) *Attorney, Agent, or Firm* — Renner, Otto, Boisselle & Sklar, LLP

(57) ABSTRACT

A safety device for a motor vehicle, which has a striker, a pawl, an ejection spring ejecting the striker, and a rotary latch, wherein the rotary latch has an opening direction of rotation, a closing direction of rotation an open position, and a main locking position, wherein the ejection spring has a leg and the leg lies directly against the striker in the main locking position of the rotary latch and the leg lies directly against the rotary latch in at least one intermediate position of the rotary latch, in which the rotary latch is between the main locking position and the open position.

8 Claims, 3 Drawing Sheets

Figure 1A:
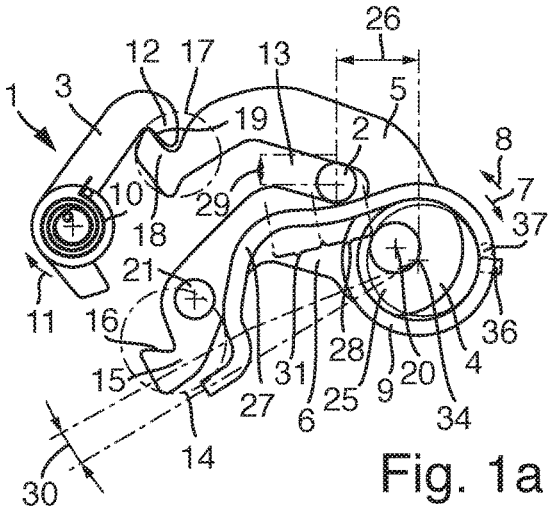
Figure 1B:
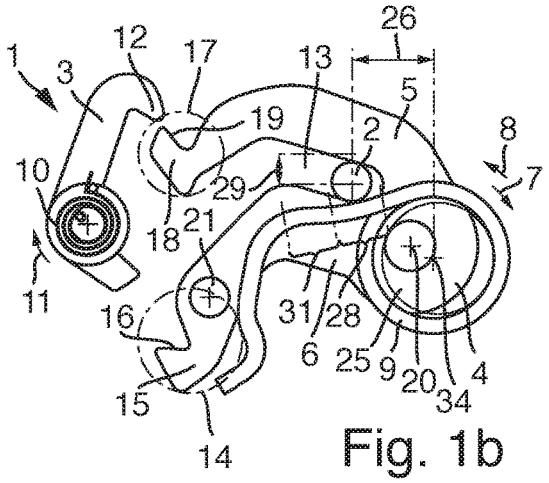

(51) Int. Cl.
*E05B 15/00* (2006.01)
*E05B 15/04* (2006.01)

(56) References Cited

FOREIGN PATENT DOCUMENTS

| | | | | | |
|---|---|---|---|---|---|
| DE | 102010061518 | | | 4/2012 | |
| DE | 102010061518 | A1 | * | 4/2012 | ..... E05B 83/24 |
| EP | 2851495 | | | 3/2015 | |
| FR | 2488935 | A1 | | 2/1982 | |
| FR | 2889230 | A1 | * | 2/2007 | ..... E05B 65/006 |
| FR | 2897380 | A1 | * | 8/2007 | ..... E05B 83/24 |
| GB | 2402961 | A | | 12/2004 | |
| WO | 2015139678 | | | 9/2015 | |

* cited by examiner

SAFETY DEVICE FOR A MOTOR VEHICLE HAVING A ROTARY LATCH AND AN EJECTION SPRING

The invention relates to a safety device for a motor vehicle which has a striker, a pawl, an ejection spring for ejecting the striker and a rotary latch, wherein the rotary latch has an opening direction of rotation, a closing direction of rotation, an open position and a main locking position.

Such a safety device is described in DE 10 2010 037 937 A1, wherein the ejection spring is provided for support purposes when shifting the safety device from the closure position into the loose position. In addition to the ejection spring, the safety device has a rotary latch spring to act on the rotary latch, wherein the ejection spring is arranged outside of a trajectory along which an external circumference of the rotary latch moves. The consequence of this is that additional installation space is required for the ejection spring and it also has the disadvantage that the motor vehicle lock has a comparatively large installation space in a motor vehicle. Furthermore, an overall weight of the motor vehicle lock is increased by an additional ejection spring alongside the rotary latch spring.

The object of the present invention is therefore to provide a safety device in which the necessary installation space is reduced.

According to the invention, this object is solved by a safety device with the characteristics of patent claim 1. Advantageous designs with expedient further formations of the invention result from the remaining patent claims, the description and the figures. In particular, one or several characteristics from the independent claim and the dependent claims can also be supplemented and/or replaced by one or several characteristics from the description. One or several characteristics from respectively different configurations of the invention can also be associated with further formations of the invention.

In order to provide a safety device in which the necessary installation space is reduced, a safety device for a motor vehicle is proposed which has a striker, a pawl, an ejection spring to eject the striker and a rotary latch, wherein the rotary latch has an opening direction of rotation, a closing direction of rotation, an open position and a main locking position. Furthermore, it is provided for that the ejection spring has a leg and the leg lies directly adjacent on the striker in the main locking position of the rotary latch and in at least an intermediate position of the rotary latch, in which the rotary latch is located between the main locking position and the open position the leg is directly adjacent on the rotary latch.

The rotary latch has a load arm and a catch arm, wherein the catch arm and the load arm form a fork-shaped infeed section of the rotary latch which accommodates the striker during a closure process of the rotary latch. The catch arm and the load arm respectively have a head area, wherein both head areas are advantageously the areas of the rotary latch furthest from a pivot axis of the rotary latch. Both head areas form an opening of the infeed section which the striker enters into during the closure process of the rotary latch. The head areas can preferably extend up to one fifth of a length of the catch arm or the load arm from the respective end of the catch arm or the load arm to the pivot axis of the rotary latch. The load arm and the catch arm are preferably formed at least partially arch-shaped in order to enable guidance of the striker within the infeed section during a closure movement of the rotary latch.

The rotary latch has a main ratchet, wherein in the main locking position the pawl encompasses the main ratchet and blocks the rotary latch in the opening direction of rotation. The safety device is bolted in the main locking position of the rotary latch, wherein a front hood on which the striker is preferably attached assumes a closure position. In the open position of the rotary latch the striker or the front hood arranged on the striker is released from the rotary latch. The opening direction of rotation of the rotary latch is the direction in which the rotary latch pivots from the main locking position to the open position. The closing direction of rotation is the direction of rotation opposite the opening direction of rotation.

Ejection of the striker means that the striker is moved such that after ejection the striker is released from the rotary latch, wherein the rotary latch is located in the open position. In one embodiment, the ejection spring supports ejection of the striker, at least partly, preferably at the start of ejection of the striker. Direct adjacency of the leg to the rotary latch means in particular that the leg either lies directly adjacent to the rotary latch or lies adjacent to a component of the safety device, the relative speed of which to the rotary latch is equivalent to zero and is connected to the rotary latch. For example, the rotary latch can have a tappet which is connected to a main material of the rotary latch in an interlocking manner. Direct adjacency of the leg to the tappet, the relative speed of which to the rotary latch is equivalent to zero in all directions, corresponds to direct adjacency to the rotary latch according to the invention. Especially advantageously, the ejection spring drives the rotary latch initially indirectly via the striker and then directly into the opening direction of rotation by means of the tappet during ejection of the striker. The tappet is preferably formed as a single component with the rotary latch and as a pin or mandrel, for example. The ejection spring is preferably executed as a leg spring which is stressed for torsion around its pivot axis.

According to the invention, the leg lies directly adjacent to the striker in the main locking position of the rotary latch. Directly means in particular that no further component is provided for between the leg and the striker. A main spring material of the ejection spring which preferably lends the ejection spring spring stiffness is located directly adjacent to the striker in the main locking position of the rotary latch. The leg preferably extends at least up to a radius from 3 to 5 cm, starting from a pivot axis of the ejection spring.

The pivot axis of the ejection spring preferably runs parallel to a pivot axis of the rotary latch. A first variant provides for ejection springs and the rotary latch having a common pivot axis. In this case, the safety device can be configured very compact, wherein the installation space required in the safety device is reduced. Furthermore, configuration of the ejection spring is facilitated to the extent that a torque which acts on the ejection spring also acts directly or indirectly on the rotary latch and thus, during configuration of the safety device, no conversion of a torque generated by the ejection spring to a torque acting on the rotary latch is necessary.

A second variant provides for the pivot axis of the ejection spring being arranged displaced to the pivot axis of the rotary latch. Advantageously, the pivot axis of the rotary latch is arranged between a pivot axis of the pawl and the pivot axis of the ejection spring which provides an enlarged lever arm of the ejection spring compared to the first variant during impingement of the rotary latch. The ejection spring is preferably positioned by means of a bearing socket.

In the intermediate position of the rotary latch the rotary latch is rotated in the opening direction of rotation starting from the main locking position, preferably rotated by at least fifty to sixty degrees. Advantageously, the leg lies adjacent to the rotary latch in several intermediate positions, wherein respective positions of the leg form a circular sector in the intermediate positions, which is located in the main locking position of the rotary latch in the opening direction of rotation starting from a position of the leg.

The ejection spring acts on the rotary latch directly in the intermediate position and indirectly by means of the striker in the opening direction of rotation in the main locking position, wherein preferably contact between the striker and the infeed section of the rotary latch exists at every position of the leg during movement of the rotary latch from the main locking position to the open position. This can advantageously reduce noise emission of the safety device compared to a safety device in which permanent contact is not guaranteed between the striker and the infeed section.

Furthermore, by means of the proposed safety device with the leg of the ejection spring an additional rotary latch spring to drive the rotary latch can be dispensed with, wherein on the one hand the necessary installation space for the safety device and, on the other hand, the overall weight of the safety device is reduced.

An advantageous configuration provides for the rotary latch having a main locking position and the leg lying directly adjacent to the rotary latch. The rotary latch has a pre-ratchet, wherein the pawl surrounds the pre-ratchet in the pre-locking position and blocks the rotary latch in the opening direction of rotation. The main spring material of the ejection spring preferably lies adjacent directly to the tappet of the rotary latch in the pre-locking position. In the pre-locking position of the rotary latch the safety device secures the rotary latch from rotation in the opening direction of rotation, wherein the striker which is surrounded by an infeed section of the rotary latch is blocked in the opening direction. The consequence of this is that the front hood is blocked in the opening direction. Such securing of the front hood in the pre-locking position can prevent unintentional opening of the front hood if the rotary latch was accidentally released from the main locking position.

Within the scope of the invention, it can be provided for that the leg lies alternately adjacent on the striker and the rotary latch during rotation of the rotary latch in the opening direction of rotation. Alternately means that the leg lies adjacent on the striker in a first position of the rotary latch and a contact between the leg and the rotary latch is canceled and in a second position of the rotary latch in which the rotary latch is pivoted from the first position in the opening direction of rotation the leg lies adjacent on the rotary latch, for example the tappet and a contact between the striker and the leg is canceled. By means of such a change in adjacency of the leg, it can be enabled that during rotation of the rotary latch in the opening direction of rotation, preferably starting from the main locking position, via the pre-locking position to the open position, the leg can span a larger circular sector compared to an embodiment in which no change in adjacency of the leg is provided for.

The larger the circular sector of the leg spanned, the greater the work emitted by the ejection spring during rotation of the rotary latch in the opening direction of rotation. The greater the work emitted by the ejection spring during constant overall stroke of the striker during ejection, the greater the force impact transmitted by the ejection spring directly or indirectly on the striker during ejection. A safety device which provides for an ejection spring lying adjacent alternately on the striker and the rotary latch can be equipped with an ejection spring of smaller dimensions, wherein the installation space and the weight of the safety device can be reduced.

According to an advantageous embodiment, the leg is formed in such a way that during adjacency change of the leg from the striker to the rotary latch traction is provided for between the leg and the striker.

To enable this in detail, the leg can have a curvature, wherein a relative speed is reduced between the striker and the leg during rotation of the leg. Such a reduced relative speed between the striker and the leg can increase the duration of the adjacency change of the leg from the striker to the rotary latch, wherein the traction between the leg and the striker is ensured during the adjacency change.

The traction between the leg and the striker takes place during adjacency change on the one hand directly by means of direct contact between the leg and the striker and on the other hand indirectly starting from a direct contact between the leg and rotary latch or the tappet of the rotary latch by means of direct contact of the striker with the infeed section of the rotary latch. The traction during the adjacency change can on the one hand ensure a continual opening movement of the striker during movement of the rotary latch in the opening direction of rotation which guarantees increased convenience for an operator of a front hood to be opened. On the other hand, the traction between the leg and the striker can also reduce the noise during ejection of the striker during adjacency change.

In an especially preferred embodiment, the leg has at least a first section curved to the pivot axis of the ejection spring in a first plane vertically to the pivot axis of the ejection spring. The first section is concave, i.e. curved inwards, wherein the inside starting from the leg is defined by the side on which the pivot axis of the ejection spring is located. Very advantageously, the first section lies adjacent on the striker in the main locking position of the rotary latch.

The concave curvature of the first section of the leg can cause a relative stroke section of the striker to be reduced compared to a variant in which the leg has a straight first section. The relative stroke section is calculated from the quotient of a stroke section of the striker covered as a numerator and a covered pivot angle of the leg as a denominator within a time interval.

The reduced relative stroke section of the striker during rotation of the leg in the opening direction of rotation can cause the work emitted by the ejection spring for each stroke section of the striker to be increased and the spring force of the ejection spring acting on the striker to thus be increased. Thus, in a safety device with an ejection spring with a leg with a first curved section the ejection spring can have smaller dimensions, wherein the weight and the necessary installation space of the safety device can be reduced.

In a preferred embodiment, it is provided for that the leg has at least a second section adjacent to the first section in the first plane or a second plane vertically to the pivot axis of the ejection spring, wherein the second section has a curvature oriented opposite to the first section. In this configuration, the second section is convex, i.e. curved outwards, wherein the external side is defined by the side which lies opposite viewed from the leg on which the pivot axis of the ejection spring is located.

The convex curvature of the second section can cause an increase in the stroke section of the striker for each covered pivot angle of the leg. Such an increase in the relative stroke section of the striker enables acceleration of the striker which is caused by ejection of the ejection spring to be reduced in the second section. A lesser acceleration of the striker in the second section increases the time in which the striker stretches along the second section of the leg.

During adjacency change of the leg from the striker to the rotary latch the striker preferably lies adjacent on the second section of the leg. By means of the reduction of the acceleration of the striker attained by means of the convex curvature of the second section, a period in which the adjacency change is accomplished is increased. An increase in this period can on the one hand in one configuration of the safety device facilitate adjustment of the tappet to the geometry of the leg and on the other hand reduce the noise during adjacency change and ensure traction between the leg and the striker.

In an advantageous embodiment, it is provided for that the leg has at least a third section adjacent to the second section in the first plane, the second plane or a third plane vertically to the pivot axis of the ejection spring, wherein the third section has a curvature oriented contrary to the second section. The curvature of the third section is oriented in the same way as the curvature of the first section, i.e. it is concave. The concave curvature of the third section can equally reduce a stroke section of the tappet for each pivot angle of the leg, i.e. a relative stroke section as the concave curvature of the first section can reduce a relative stroke section of the striker. Thus, the torque acting on the rotary latch by the ejection spring can be increased, wherein the ejection spring can have smaller dimensions.

The curvatures of the first, second and/or third section can run constantly over a length of the leg in a configuration with regard to the amount. In another embodiment, the amounts of the respective curvatures can vary over the length of the leg.

Within the scope of a preferred configuration, it is provided for that the first section has an almost horizontal alignment in the main locking position and lies adjacent to the striker. The alignment is specified by means of a connecting line between a start and an end of the first section, wherein the first section extends along the leg.

The almost horizontal alignment of the first section of the leg in the main locking position relates in particular to a state of the safety device in which it is installed into a motor vehicle. In the installed state, an exactly horizontal line runs parallel to a vehicle lengthwise axis of the motor vehicle. Almost horizontal means that the connecting line includes an angle of at least less than 20 degrees, preferably less than 15 degrees, with the motor vehicle lengthwise axis. Especially advantageously, the horizontal first section of the leg borders a coil of the ejection spring. The almost horizontal alignment of the first section of the leg in the main locking position can cause a normal force acting from the leg to the striker during initial rotation of the leg, almost vertical, in particular vertical to the motor vehicle lengthwise axis being aligned upwards and acting almost the entire normal force against a weight force transferred via the striker.

This can enable the ejection spring to drive the rotary latch in the opening direction of rotation and it can preferably be of smaller dimensions to eject the striker.

An advantageous further formation provides for the ejection spring being formed as a spiral spring. This can enable in particular a narrower design of the safety device compared to a safety device in which the ejection spring is executed as a leg spring. The configuration of the ejection spring as a spiral spring can in particular simplify common accommodation of the rotary latch and the ejection spring on a common pivot axis. The narrower design of the ejection spring is hereby advantageous in particular as a spiral spring compared to a leg spring, because bearings can be arranged in a bearing pairing for the joint pivot axis and thus the pivot axis can be shorter and a higher bearing load of the pivot axis is enabled to accommodate more than one component.

In a parallel patent application of the same applicant with the title "Safety device for a motor vehicle having a rotary latch and pre-locking position and a main locking position", the content of which is also made into the object of the original publication of this application with its described technical characteristics to the full extent, in which a pawl is latched in a pre-locking position of a rotary latch on a catch arm and in a main locking position of the rotary latch on a load arm of the rotary latch. First and foremost, the technical characteristics described in the parallel patent application which enable such latching of the pawl pertain to the original publication of this application. This concerns in particular the possible configurations of the delay mechanism and the procedure to open the safety device.

In a further parallel patent application of the same applicant with the title "Safety device for a motor vehicle having a rotary latch and a protective position", the content of which is also fully made into the object of the original publication of this application with its described technical characteristics, a safety device is described with a blocking element to block a rotary latch in a closing direction of rotation. First and foremost, the technical characteristics described in the parallel patent application which increase the safety of the safety device pertain to the original publication of this application. This affects in particular the configuration of the blocking element and the interaction of the blocking element with the pawl and the rotary latch.

Other advantages, characteristics and details of the invention result from the following description, at least of a preferred exemplary embodiment to which the invention is not restricted, however, and on the basis of the figures.

Figure 3:
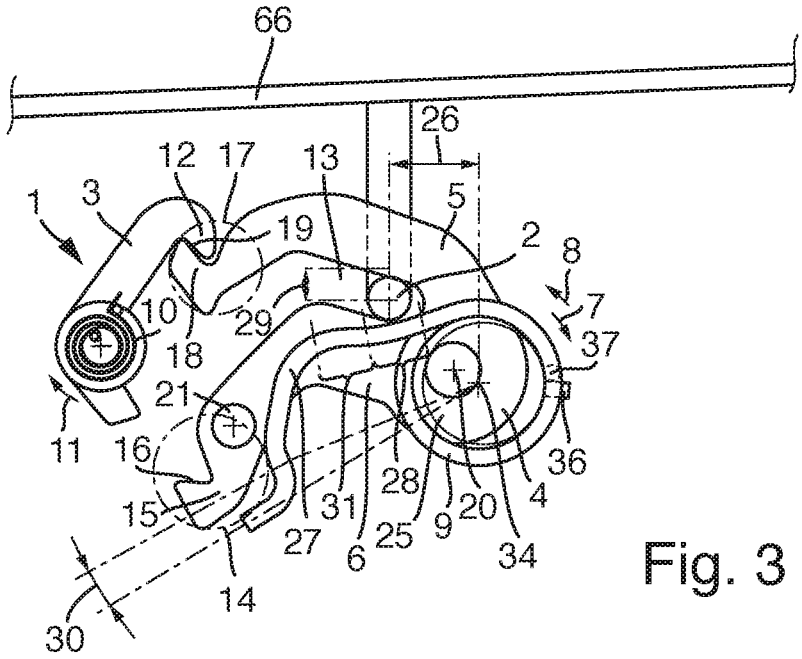

These show:

FIG. 1*a*-1*f* and FIG. 2*a*-2*b* a sectional view of a safety device during an opening process;

FIGS. 2*c* to 2*f* a sectional view of the safety device according to FIG. 1*a* during a closure process;

FIG. 3 a sectional view of the safety device according to FIG. 1*a* and a front hood arranged on a striker.

FIG. 1*a* to 1*f* and FIGS. 2*a* to 2*b* show a safety device 1 for a motor vehicle during an opening process. The safety device 1 has a striker 2, a pawl 3 and a rotary latch 4. The rotary latch 4 has a load arm 5, a catch arm 6, an opening direction of rotation 7, a closing direction of rotation 8, a pre-locking position and a main locking position. Furthermore, the safety device 1 has an ejection spring 9 which is tensioned in the closure direction 8 of the rotary latch 4 to eject the striker 2 and acts on the rotary latch 4 in the opening direction of rotation 7. The ejection spring 9 preferably has a fixed end 36, which is braced on a static support 37 of the safety device 1. The fixed end 36 advantageously extends to a bearing socket 25 and surrounds the bearing socket 25, such that the fixed end 36 is immobile in relation to the pivot axis 34 of the ejection spring 9. The pawl 3 has a pawl spring 10 which acts on the pawl 3 in a locking direction of rotation 11. Furthermore, the pawl 3 has a latch nose 12 which secures the rotary latch 4 in the main locking position of the rotary latch 4 shown in FIG. 1*a* against rotation in the opening direction of rotation 7.

The catch arm 6 and the load arm 5 form a fork-shaped infeed section 13 of the rotary latch 4 which accommodates the striker 2. The load arm 5 and the catch arm 6 are formed at least partially arch-shaped in order to enable guidance of the striker 2 within the infeed section 13 during a closure movement and an opening movement of the rotary latch 4.

The catch arm 6 has a head area 14 with a bending tangent 15 in the direction of the opening direction of rotation 7, wherein the bending tangent 15 forms a pre-ratchet 16. Furthermore, the load arm 5 has a head area 17 with a bending tangent 18 in the direction of the opening direction of rotation 7, wherein the bending tangent 18 forms a main ratchet 19. In the main locking position of the rotary latch 4 shown in FIG. 1*a* the latch nose 12 surrounds the main ratchet 19. In the main locking position of the rotary latch 4 the ejection spring 9 furthermore acts on the rotary latch 4 in the direction of the opening direction of rotation 7 by means of the striker 2, wherein the main ratchet 19 presses against the latch nose 12 of the pawl 3 and thus generates pressure on a contact surface of the latch nose 12, which additionally holds the pawl with the force acting by means of the pawl spring 10 in a locked position shown in FIG. 1*a*.

The rotary latch 4 can be loosened by means of a rotation of the pawl 3 against the locking direction of rotation 11 to a release position from the pre-locking position and from the main locking position. If the load arm 5 or the catch arm 6 of the rotary latch 4 can be passed in the opening direction of rotation 7 on the latch nose 12 of the pawl, the pawl 3 is located in the release position.

The ejection spring 9 is preferably formed as a leg spring, wherein the ejection spring 9 has a leg 27 and a main spring material which lends the ejection spring 9 spring stiffness. The main spring material is preferably metal. It is provided for that the striker 2 lies directly adjacent to the leg 27 in the main locking position, preferably on the main spring material. A configuration within the scope of the invention provides for the main spring material being equipped with a protective cover, wherein the protective cover is viewed as part of the leg 27. In this case, the leg 27 lies directly adjacent to the striker 2 in the main locking position.

Figure 1D:
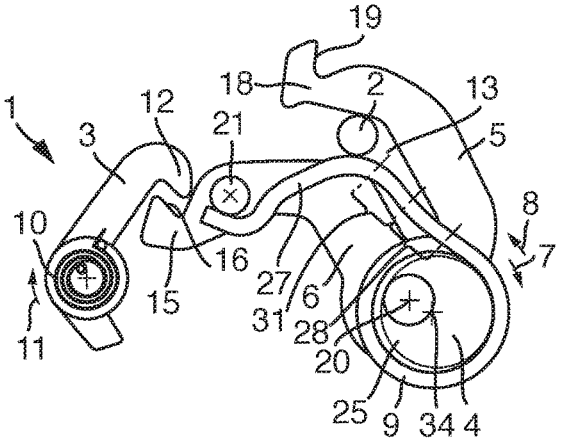
Figure 2A:
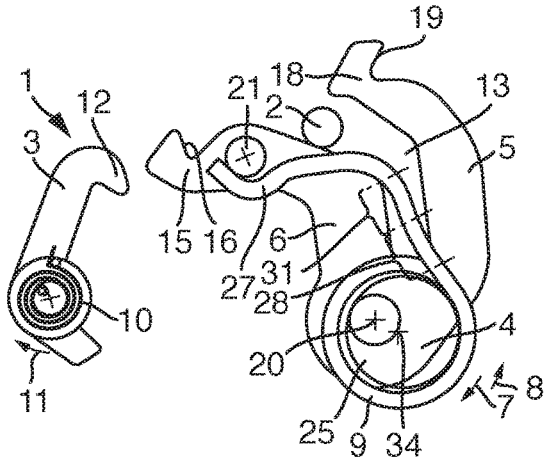
Figure 2B:
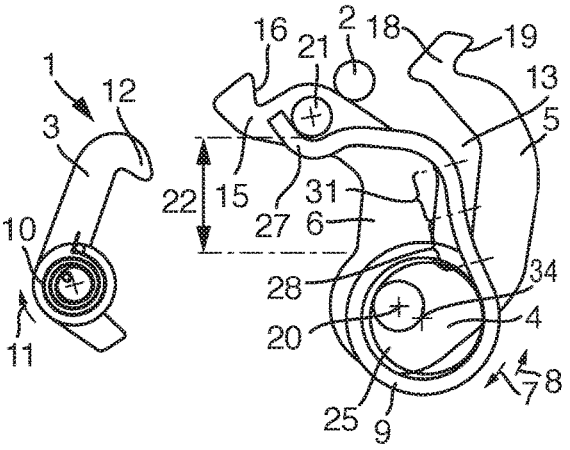

FIG. 2*b* shows the rotary latch 4 in an open position in which the striker 2 is released from the load arm 5 of the rotary latch 4, i.e. blockage of a movement of the striker 2 upwards by the load arm 5 is cancelled. FIG. 1*d* shows the rotary latch 4 in an intermediate position in which the rotary latch 4 is located between the main locking position and the open position and is rotated into the opening direction of rotation 7 starting from the main locking position. In the intermediate position shown in FIG. 1*d*, the leg 27 lies directly on a tappet 21 of the rotary latch 4, i.e. on the rotary latch 4. In a special configuration, the tappet 21 is part of the surface of the catch arm 6. In any case, the tappet 21 is connected to the catch arm 6, so that a relative speed between the tappet 21 and the rotary latch 4 is equal to zero and thus direct adjacency of the leg 27 to the tappet 21 corresponds to direct adjacency of the leg to the rotary latch 4.

In the open position of the rotary latch 4 shown in FIG. 2*b*, the leg 27 also lies adjacently directly on the rotary latch 4. Furthermore, in the open position a contact between the striker 2 and the leg 27 is lifted.

As the leg 27 lies directly adjacent to the rotary latch 4 in the open position of the rotary latch 4, the rotary latch 4 is acted on in the opening direction of rotation 7, and the catch arm 6 is kept depressed against the striker 2. Thus, by means of the ejection spring 9, a lifting force can be transmitted on the striker 2 and a contact between the catch arm 6 and the striker 2 is ensured in the open position of the rotary latch 4.

Maintenance of a contact between the catch arm 6 and the striker 2 during ejection of the striker 2 can reduce noise during ejection of the striker 2 compared to a configuration in which the leg 27 lies adjacent on the striker 2 in the open position and can cause stopping of the striker 2 on an internal surface of the load arm 5.

Furthermore, as shown in FIG. 2*b*, a lifting force acting directly on the rotary latch 4 during opening of the rotary latch 4 to the open position can enable enlargement of a stroke path 22 of the striker 2 compared to a variant in which the leg 27 lies adjacent solely on the striker 2 during opening of the rotary latch 4. An increase of the stroke path 22 increases operator convenience of a front hood connected to the striker 2 to the extent that an engagement area is increased between an edge of the front hood and a further edge of a motor vehicle chassis located thereunder, wherein grasping of the front hood is facilitated.

In the embodiment of the safety device 1 shown in FIGS. 1*a* to 1*f* and 2*a* to 2*f*, the ejection spring 9 has a pivot axis 34, which is arranged in a displaced manner to a pivot axis 20 of the rotary latch 4. A lever arm 26 shown in FIG. 1*a*, which extends between the central point of the striker 2 and the pivot axis 34 of the ejection spring 9 is enlarged by means of the displaced pivot axes 34 and 20 compared to a safety device in which the ejection spring 9 and the rotary latch 4 have a common pivot axis. In a different configuration, the rotary latch 4 and the ejection spring 9 have a common pivot axis. This has the advantage of a more compact design and weight saving.

Hereafter, the image plane of FIG. 1*a* is viewed which is aligned vertically to the pivot axis 34 of the ejection spring 9 and constitutes a first plane.

The leg 27 of the ejection spring 9 has a first section 28, which is curved in the first plane to the pivot axis 34 of the ejection spring 9 and preferably lies adjacent to a coil of the ejection spring 9.

The first section 28 is concave, i.e. curved inwards, wherein the inside in relation to the leg 27 is defined by the side on which the pivot axis 34 of the ejection spring 9 is located. In the main locking position of the rotary latch 4 illustrated in FIG. 1*a*, the first section 28 lies adjacent on the striker. The concave curvature of the first section 28 of the leg 27 can cause reduction of a stroke section 29 of the striker 2 for each covered pivot angle 30 of the leg 27, hereinafter known as relative stroke section of the striker 2 during rotation of the leg 27, starting from the main locking position of the rotary latch 4 in the opening direction of rotation 7, compared to a variant in which the leg 27 has a straight first section 28.

The reduced relative stroke section of the striker 2 during rotation of the leg 27 in the opening direction of rotation 7 can cause the work emitted by the ejection spring 9 for each stroke section of the striker 2 to be increased and the spring force of the ejection spring 9 acting on the striker 2 to thus be increased. Thus, in this configuration shown in FIG. 1*a*, the ejection spring 9 can thus have smaller dimensions, wherein the weight and the necessary installation space of the safety device 1 can be reduced. FIG. 1*a* furthermore shows that the first section 28 in the main locking position includes an angle of approximately 12 degrees with a horizontal line in the image plane of FIG. 1*a*, i.e. is aligned almost horizontally.

Furthermore, the leg 27 has a second section 31 adjacent to the first section 28, wherein the second section 31 has a curvature of an opposite orientation to the first section 28. The second section 31 is convex, i.e. curved outwards, wherein the external side is defined by the side which lies opposite viewed from the leg 27 on which the pivot axis 34 of the ejection spring 9 is located.

The convex curvature of the second section 31 can cause an increase in the relative stroke section of the striker 2, wherein acceleration of the striker 2 which is caused by the ejection spring 9 can be reduced if the striker 2 glides along the second section 31. As explained in the general description, reduction of the acceleration of the striker can reduce a noise during adjacency change.

An adjacency change of the leg 27 during ejection of the striker 2 from an adjacency of the leg 27 to the striker 2 to an adjacency of the leg 27 on the rotary latch 4 is described hereafter. Starting from the main locking position of the rotary latch 4 shown in FIG. 1*a*, the pawl 3 is transferred from the locked position, preferably by means of an electrical drive, into the release position shown in FIG. 1*b*. The rotary latch 4 released in the opening direction of rotation 7 is accelerated by means of the ejection spring 9 via contact between the striker 2 and the load arm 5 and is rotated into the position shown in FIG. 1*c*.

Figure 1C:
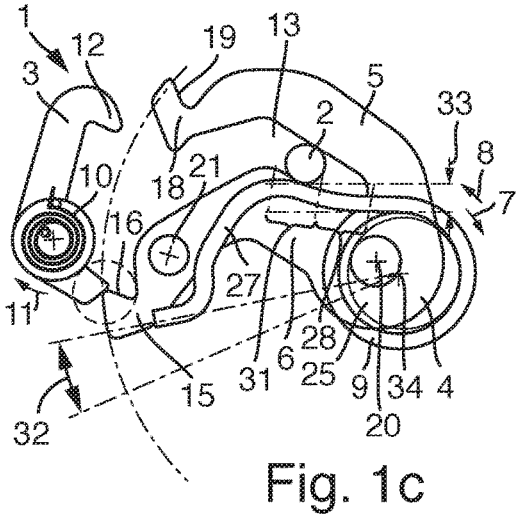
Figure 1E:
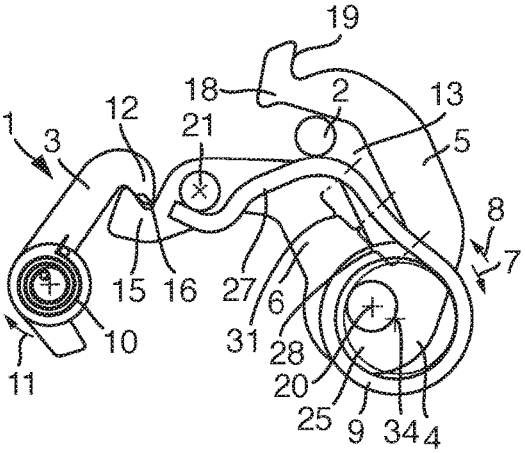

FIG. 1*c* shows the rotary latch 4 in a position between the main locking position and a pre-locking position shown in FIG. 1*e*. Compared to the position of the rotary latch 4 shown in FIG. 1*b* the leg 27 is pivoted around an angle 32 in the opening direction of rotation 7 and the striker 2 is lifted upwards around a stroke section 33. A relative stroke section of the striker 2 is calculated, for example, in the position of the rotary latch 4 shown in FIG. 1*c* from the quotient of the stroke section 33 as a numerator and the covered pivot angle 32 of the leg 27 as a denominator. In the position of the rotary latch 4 shown in FIG. 1*c*, the leg 27 lies adjacent on the striker 2, but not on the rotary latch 4 or the tappet 21. Furthermore, in the position of the rotary latch 4 shown in FIG. 1*c*, the bending tangent 15 is blocked by a boom of the pawl 3. After such a blockage, the pawl 3 rotates in an impinged manner by the pawl spring 10 into the locking position which is shown in FIG. 1*d*, wherein the blockage by the boom is lifted.

Starting from the position of the rotary latch 4 shown in FIG. 1*c*, the rotary latch 4 is rotated by means of the ejection spring 9 via the striker 2 and a contact between the striker 2 and the load arm 5 in the opening direction of rotation 7. Shortly before attainment, preferably roughly with a pivot angle of 2 to 5 degrees before attainment, of the pre-locking position of the rotary latch 4 the leg 27 lies adjacent to the tappet 21. Simultaneously, the leg 27 lies adjacent on the striker 2. The second curved section 31 preferably extends beyond the edges shown in the Figures in the direction of the open end of the leg 27 and is curved convexly in this configuration that the leg 27 lies directly adjacent during further rotation of the rotary latch 4 from the position of the rotary latch 4 shown in FIG. 1*d* both on the striker 2 and also on the tappet 21. Thus, a relative speed can be reduced to practically zero between the leg 12 and the tappet 21 during impacting of the leg 27 on the tappet 21, wherein a noise is reduced during impacting of the leg 27 on the tappet 21.

FIG. 1*e* shows the rotary latch 4 in the pre-locking position, wherein the pawl 3 blocks the catch arm 6 and thus the rotary latch 4 in the opening direction of rotation 7. In the pre-locking position the leg 27 lies directly adjacent both on the striker 2 and also on the tappet 21 and thus on the rotary latch 4. Starting from the pre-locking position of the rotary latch 4 shown in FIG. 1*e*, the pawl 3 is rotated from the locking position to the release position. This can preferably occur manually. In the release position of the pawl 3, the rotary latch 4 is released in the opening direction of rotation 7 and is accelerated by means of direct contact between the leg 27 and the tappet 21 by means of the ejection spring 9 in the opening direction of rotation 7, as shown in FIG. 1*f*.

Figure 1F:
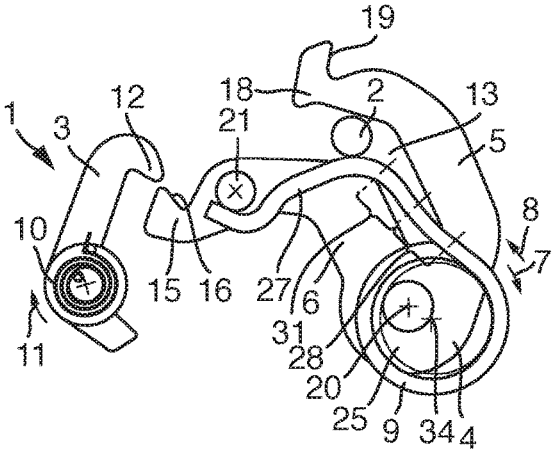

FIG. 2*a* shows a position of the rotary latch 4, in which the rotary latch 4 is pivoted in an opening direction of rotation 7 compared to the position shown in FIG. 1*f*. In this position of the rotary latch 4, in which the rotary latch 4 is still not in the open position, contact is canceled between the leg 27 and the striker 2 and the leg 27 lies adjacent on the tappet 21. The movement course starting from FIG. 1*c* via FIG. 1*d*, FIG. 1*e*, FIG. 1*f* to FIG. 2*a* shows an adjacency change of the leg 27 from the striker 2 to the rotary latch 4, wherein the leg 27 is formed in such a way that, during adjacency change, a traction is provided for between the leg 27 and the striker 2. In each of the positions of the rotary latch 4 attained during adjacency change, traction is provided for between the leg 27 and the striker 2, either by means of direct contact between the leg 27 and the striker 2 or by means of direct contact of the leg 27 with the tappet 21 in conjunction with direct contact between the catch arm 6 and the striker 2.

This adjacency change causes the leg 27 of the ejection spring 9 to span a larger angular area than the rotary latch 4 during ejection of the striker 2. This has the advantage that, compared to a variant without such an adjacency change, the ejection spring 9 is relaxed more greatly, wherein the ejection spring 9 emits greater work directly or indirectly on the striker 2. This has the advantage that the ejection spring 9 can have smaller dimensions and thus the installation space and the weight of the safety device 1 can be reduced.

Figure 2C:
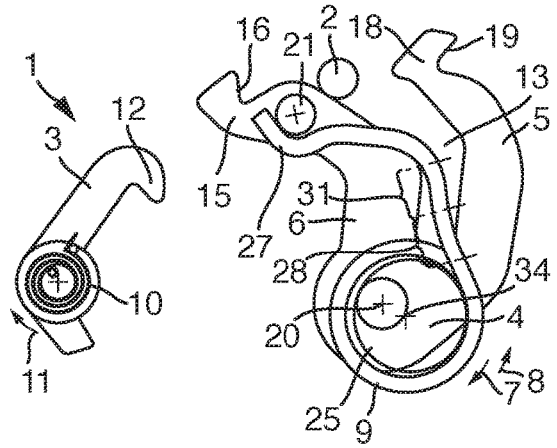
Figure 2D:
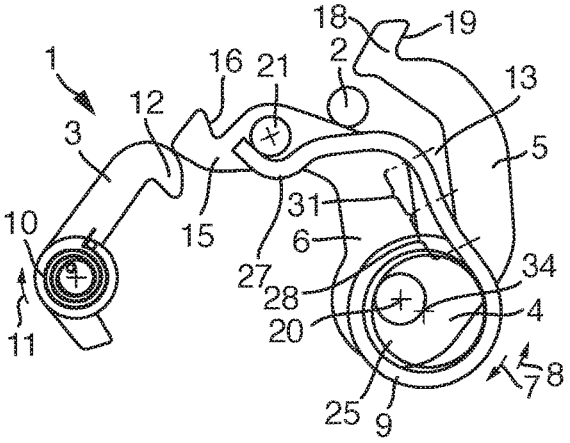
Figure 2E:
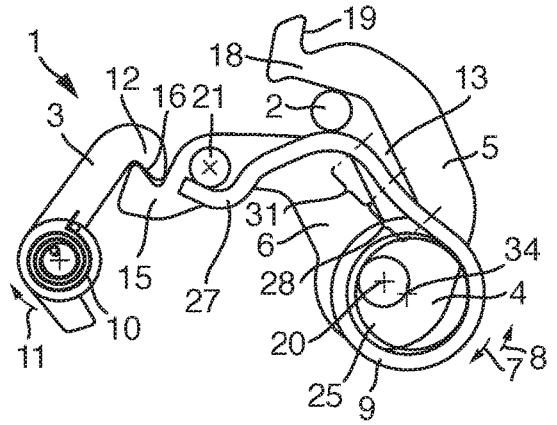
Figure 2F:
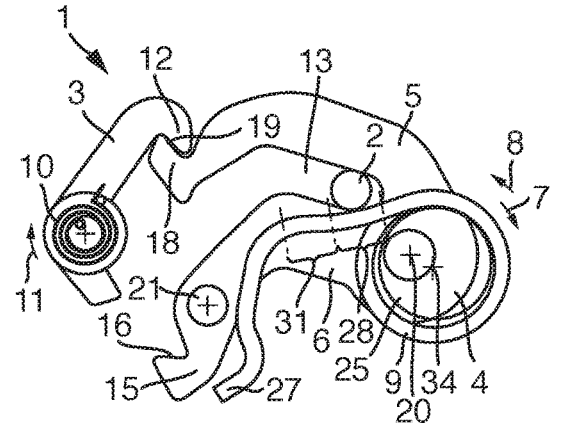

FIGS. 2*a* to 2*f* show a closure process of the safety device 1. Starting from the open position of the rotary latch 4 shown in FIG. 2*a* the striker 2 moves the rotary latch 4 into the closing direction of rotation 8 by means of the catch arm 6. During movement of the rotary latch 4 from the open position in the direction of the pre-locking position, the bending tangent 15 of the head area 14 impacts on the catch arm 6 on the latch nose 12 of the pawl 3, as shown in FIG. 2*d*. After impacting of the bending tangent 15 on the latch nose 12 the catch arm 6 pushes the pawl 3 starting from the locked position in the direction of the release position, wherein the catch arm 6 can pass the latch nose 12.

FIG. 2*c* shows the catch 4 in the pre-locking position after the catch arm 6 has passed the latch nose 12 and the pawl 3 was moved by means of the pawl spring 10 into the locked position. This position can be assumed, for example, if a front hood to which the striker 2 is attached was not depressed with sufficient force so that the rotary latch 4 attains the main locking position with one-time depression. Latching of the rotary latch 4 in the pre-locking position during a closure process of the safety device 1 prevents the rotary latch 4 reaching the open position again and thus prevents snapping open of the front hood.

If, starting from the pre-locking position of the rotary latch 4 shown in 2*e* the striker 2 is once again depressed, the bending tangent 18 impacts on the head area 17 of the load arm 5 on the latch nose 12 and rotates the pawl 3 into the release position in which the load arm 5 can pass the latch nose 12. After the load arm 5 has passed the latch nose 12, the pawl spring 10 moves the pawl 3 into the locking position in which the latch nose 12 encompasses the bending tangent 18 of the head area 17 of the load arm 5 and the rotary latch 4 assumes the main locking position.

FIG. 3 shows a front hood 66 arranged on the striker 2, as can be provided for, for example, in the safety device 1 located in a state installed in a motor vehicle. The safety device 1 is preferably arranged in a front area of the front hood 66. Alternatively, the safety device 1 can be arranged in a rear area of the front hood 66.

The invention claimed is:

1. A safety device for a motor vehicle, comprising:

a striker, a pawl, an ejection spring for ejecting the striker, and a rotary latch, wherein the rotary latch has an opening direction of rotation, a closing direction of rotation, an open position, and a main locking position, and wherein the ejection spring has a leg and the leg lies directly against the striker in the main locking position of the rotary latch and the leg lies directly against the rotary latch in at least one intermediate position of the rotary latch, in which the rotary latch is between the main locking position and the open position, wherein the ejection spring is formed as a spiral spring, and wherein the rotary latch and the ejection spring are accommodated on a common pivot axis.

2. The safety device according to claim 1, wherein the rotary latch has a pre-locking position and the leg lies directly adjacent on the rotary latch in the pre-locking position.

3. The safety device according to claim 1, wherein the leg lies adjacent alternately on the striker and the rotary latch during rotation of the rotary latch in the opening direction of rotation.

4. The safety device according to claim 1, wherein the leg is formed in such a way that during adjacency change of the leg from the striker to the rotary latch traction is provided for between the leg and the striker.

5. The safety device according to claim 1, wherein the ejection spring has a pivot axis and the leg in a first plane vertical to the pivot axis has a first section curved to the pivot axis.

6. The safety device according to claim 5, wherein the leg in the first plane or a second plane vertical to the pivot axis has at least a second section adjacent to the first section, wherein the second section has a curvature oriented opposite the first section.

7. The safety device according to claim 6, wherein the leg in the first plane, the second plane or a third plane vertical to the pivot axis has at least a third section adjacent to the second section, wherein the third section has a curvature oriented opposite the second section.

8. The safety device according to claim 1, wherein a first section of the leg has an almost horizontal alignment in the main locking position and lies adjacent on the striker.

* * * * *